United States Patent [19]

Goertz

[11] Patent Number: 4,947,603

[45] Date of Patent: Aug. 14, 1990

[54] UNITARY FOAM/GRAVEL ROOF

[76] Inventor: Alois Goertz, 4 Retford Ave., Cranford, N.J. 07016

[21] Appl. No.: 258,624

[22] Filed: Oct. 17, 1988

Related U.S. Application Data

[63] Continuation-in-part of Ser. No. 97,059, Sep. 16, 1987.

[51] Int. Cl.[5] ..... E04B 7/00; E04B 5/00

[52] U.S. Cl. ..... 52/309.4; 52/408

[58] Field of Search ..... 52/309.4, 309.8, 309.9, 52/506, 745, 746, 2 E, 408

[56] References Cited

U.S. PATENT DOCUMENTS

| | | | |
|---|---|---|---|
| 2,335,300 | 11/1943 | Neff | 52/2 E X |
| 3,266,206 | 7/1962 | Cosby et al. | 52/309.9 |
| 3,277,219 | 10/1966 | Turner | 52/2 E X |
| 3,411,256 | 11/1968 | Best | 52/408 |
| 3,619,343 | 11/1971 | Freeman | 428/142 |
| 3,677,784 | 7/1972 | Sterrett et al. | 106/309 |
| 3,763,614 | 10/1973 | Hyde et al. | 52/309.9 |
| 3,965,633 | 6/1976 | Carroll | 52/309.8 |
| 4,045,934 | 9/1977 | Sheahan et al. | 52/309.4 |
| 4,073,997 | 2/1978 | Richards et al. | 52/309.4 X |
| 4,274,238 | 6/1981 | O'Riordain | 52/408 |
| 4,351,138 | 9/1982 | McMillan et al. | 52/309.4 |
| 4,368,604 | 1/1983 | Spielau et al. | 52/309.8 |
| 4,396,686 | 8/1983 | Fiorio | 428/623 |
| 4,492,064 | 1/1985 | Bynoe | 52/309.8 |
| 4,574,554 | 3/1986 | Gentry | 52/105 X |
| 4,642,950 | 2/1987 | Kelly | 52/90 |
| 4,651,494 | 3/1987 | Van Wagoner | 52/593 |
| 4,653,246 | 3/1987 | Hepler | 52/787 |
| 4,719,723 | 1/1988 | Van Wagoner | 52/15 |

FOREIGN PATENT DOCUMENTS

| | | | |
|---|---|---|---|
| 2532100 | 2/1977 | Fed. Rep. of Germany | 52/309.8 |
| 2310452 | 12/1976 | France | 52/309.4 |

*Primary Examiner*—David A. Scherbel
*Assistant Examiner*—Michele A. Van Patten
*Attorney, Agent, or Firm*—Omri M. Behr

[57] ABSTRACT

A sprayed closed cell foam roof is prepared by applying the foam directly to the entire roof deck and layering the foam with sufficient gravel to prevent ultraviolet light deterioration of the foam. The roof is devoid of the waterproof layer conventional in foam roofs that leads to leaks and other failures common to such roofs.

12 Claims, 1 Drawing Sheet

UNITARY FOAM/GRAVEL ROOF

RELATED APPLICATIONS

This application is a continuation-in-part of Applicant's copending application, Ser. No. 097,059, filed 9/16/87.

BACKGROUND OF THE INVENTION

Sprayed, closed-cell foam roofs originated in the 1950's in the wake of the development of the foams after World War II. The foam is typically made of two components which, when mixed together, give off an exothermic reaction. This causes the mixture to expand, trapping Freon in the cells and forming a material with insulating properties superior to any other commercially available insulation. (See RSI, June 1982, pp. 44–48).

The sprayed-in-place feature allows a contractor to provide an essentially seamless roof. Typically, the foam layer is sprayed onto the roof deck, coated with a waterproof layer and then covered with a layer of gravel. See for instance, the North Carolina Foam Industries, Inc. information sheet on Graveledfoam TM Roof Systems.

Numerous types of water impermeable coatings have been utilized throughout the years in an effort to prevent the sprayed foam layer from becoming waterlogged, thus, resulting in leaks or other roof failure. Moore and Kashiwagi, (30th Annual Polyurethane Technical/Marketing Conference, Oct. 15–17, 1986, pp. 93–98), lists coatings of silicone, silicone and acrylic, asphalt and urethane. The roofing industry's position has always been that the foam is permeable to water and thus, it is necessary to protect it with a water-impermeable coating.

Ultraviolet degradation, heavy traffic, or movement of equipment across foam roofing will cause damage to the foam surface in the form of open or broken cells. Water will infiltrate into such cells. A water-impermeable coating prevents infiltration of water into such cells providing that the coating is totally intact and perfectly adhered. Any break in the coating would allow water to enter and flow laterally between the coating and the damaged foam surface. The ultimate result is that the foam becomes water-logged and the roof fails.

Additionally, there is a vapor drive from the inside of a building to the outside. When the roof deck has the insulating foam on top of it and the waterproof coating on top of the foam, the water vapor diffuses through the foam and condenses on the underside of the coating. Thus, a potentially destructive layer of water forms between the foam and its coating. Again, the ultimate result is that the foam becomes water-logged and the roof fails.

DESCRIPTION OF THE PRIOR ART

Despite the theory of water vapor drive, the requirement of a waterproof layer is found in essentially all roofing systems. For instance, U.S. Pat. No. 4,492,064 discloses a roof comprising a plurality of closed cell thermal insulation foam panels, which are disposed over a water impermeable barrier layer. U.S. Pat. No. 4,396,686 concerns a roof whose insulating layer comprises expanded polyurethane which is covered first by a zinc plated steel sheet and then by a bituminous coating. The U.S. Pat. No. 3,411,256 discloses a thermal insulating layer adhered to a water impermeable layer below it. Another U.S. Pat. No. 3,266,206, utilizes urethane foam layers covered by additional layers of waterproofing material which rest on waterproof sheets. Other roof structures and materials utilizing a foam layer all contain some form of vapor barrier; see, for instance, U.S. Pat. Nos. 3,763,614 (thermal insulation placed over water barrier layer); 3,619,343 (roof product of polyolefin coating for weather protection); 3,965,633 (waterproof wearing surface on exterior of foam insulation board); and 4,274,238 (drainage board above a water barrier layer and below a thermal insulation layer).

In *RSI*, February, 1987, pp. 92–100, the authors define a polyurethane foam (PUF) roof system as made up of three components: PUF, a cover and a vapor barrier. The purpose of the PUF is to form a closed cell waterproofing barrier to protect the facility against water leakage and to provide insulation. The typical problems identified with PUF are: (1) condensation of moisture in the top layers of the PUF; (2) freezing of moisture-laden PUF cells, causing a loss of insulation, structural and waterproofing capability; (3) improper cell formation; (4) disbonding of the PUF layers due to inadequate thicknesses, presence of moisture between passes or burnt PUF surfaces; and (5) improper PUF structural capability.

The second required component of the PUF roof system is the cover. Its requirements are that it protects the PUF from ultraviolet rays and distribute point loadings out over a wide area not to exceed the structural requirements on the PUF.

The last component of the PUF roof system is the vapor barrier. The purpose of the vapor barrier is to prevent moisture from entering the PUF from the inside of a structure.

SUMMARY OF THE INVENTION

It is an object of the invention to provide a sprayed closed cell foam roof which allows the free passage of water vapor to obviate the problems caused by entrapment of water vapor.

It is a still further object of this invention to provide a sprayed closed cell foam roof which is devoid of a waterproof layer conventional in foam roofs.

A still further object of the present invention is to provide a method of preparing an unbroken layer sprayed foam roof layer or an air permeable roof deck which is devoid of a waterproof layer and which lacks the problems associated with conventionally prepared sprayed foam roofs.

The present invention concerns as roof consisting essentially of an air and water vapor permeable roof deck directly supporting an unbroken sprayed closed cell foam material overlayered with gravel in an amount sufficient to prevent ultraviolet light deterioration of the foam, and the method of preparing same.

DESCRIPTION OF THE PREFERRED EMBODIMENTS

Figure 1:
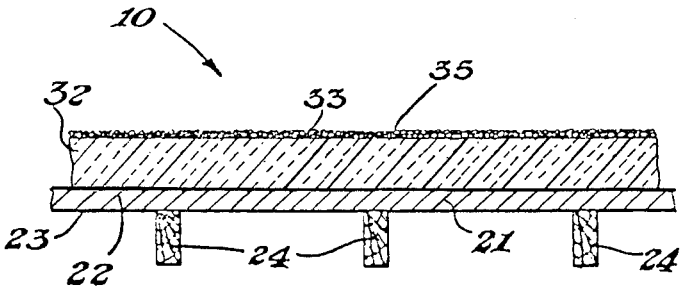
FIG. 1 is a cross sectional view of a roof of the present invention.

The roof of the present invention is prepared by applying and affixing directly to an air and water vapor permeable roof deck, a sprayed closed cell foam material causing the entire roof surface and directly applying thereto a layer of gravel sufficient to prevent ultraviolet light deterioration of the foam. The resultant roof is thus devoid of any waterproof vapor barrier such as is conventionally found in typical roof systems.

The sprayed closed cell foam material utilized in the present invention may be any of the conventionally available foams. Such foams are prepared by mixing two components, which chemically react to form the foamed material. Numerous such materials are available, typically they are combined of A-isocyanate and B-polyol, which react to give a polyurethane foam. By varying the amounts of each component, foams of differing densities can be obtained. Typically, for roofing structures, a density of from about 1.75 to 5 lbs./cu. ft., suitably 1.75–3.5 lbs./cu. ft. is desired in the foam product. Lesser densities have insufficient mechanical strength, while the use of higher densities is wasteful.

The sprayed closed cell foam material is applied to the roof deck utilizing conventional spraying equipment. For standard roof structures, the foam is applied to the roof deck to a depth of 1 inch or greater, with the usual finished depth being about 1–1½ inches. Typically, the foam is applied in layers of about 1–1½ inches, so that when a depth of greater than 1 inch is required, more than one layer of foam is applied to the roof. There is no upper limit, but greater numbers of layers are wasteful.

The foaming action depends upon the ambient temperature. Most commercial mixtures are formulated with Freons which are set to produce satisfactory foams at ambient temperatures of between about 50° and 70° F. Operation outside these ranges which require use of Freon formulations which are commercially available and known to those skilled in the art.

Commercial Formulations include:

PDL 110-2 and PDL 106, both manufactured by Polymer Development Laboratories, Dickson Street, Newburgh, N.Y. 12550. The former is a Uniform Building Code (UBC) Class 1 foam, available in 2.0, 2.5 and 3.0 lbs./cu.ft. formulations. The latter is a UBC Class II foam. It is available in 1.5 thru 3.0 lbs. cu./ft. foamulations and is sold in summer and winter grades for applications between 50° and 100° F.

There may also be used NFCI spray systems 362-82 and 225 manufactured by North Carolina Foam Industries, Inc., P.O. Box 1528, Mount Airy, N.C. 27030. The former spray provides a core density of 2 lbs./cu.ft.; the latter of 1.9 lb./cu.ft. A further foam system is the UTC 025 spray foam system made by Urethane Technology Co. Inc., Dickson Street, Newburgh, N.Y. 12550. The system offers in place densities of 2.2, 2.5 and 6 lbs./cu.ft. for their foams 025-2, 025-2.5 and 025-3 respectively.

In the case of new roofing, the foam layer is applied directly to the air and water vapor permeable roof deck according to the foam manufacturer's directions. In the usual case, this means that the roof deck surface must be free of oil, grease, rust and dirt. All surfaces must be dry and free of dew, frost or other moisture. In the case where there is an existing roof, the surface must be cleaned of loose aggregate and debris prior to application of the foam layer and prepared in such a manner as to allow air and water vapor to pass upwardly therethrough.

After the foam layer is in place, as layer of gravel sufficient to prevent ultraviolet light deterioration of the foam is applied directly to the foam layer. Generally, the amount of gravel applied is about 200–500 lbs. per 100 square foot of foam roof surface, whith 400 lbs. per 100 square foot being particularly preferred. The type and size of gravel is not critical to the invention, but that conforming to the American Society for Testing Materials, D 1863-83, Size Number 7, is particularly suitable for the preparation of roofs, according to this invention.

Thus, a roof prepared according to the present invention consists essentially of a roof deck, directly supporting a unitary, unbroken layer of closed cell foam material covering the entire roof surface, layered with gravel in an amount sufficient to prevent ultraviolet light deterioration of the foam.

Such roofs are thus devoid of the conventional waterproof layer. While not wishing to be bound by any particular theory, it is believed that roofs prepared in this manner "breathe" in such a fashion that there is no accumulation of water vapor, which can condense and cause water problems, i.e., leaks and other types of roof failures. Since the foam itself is waterproof, it needs only to be protected from the ultraviolet light to maintain its structural integrity. Since the vapor drive from within the building is allowed to naturally flow out through the sprayed foam, there is no condensation to water-log the foam.

In FIG. 1, the roof 10 comprises the roof deck 21 layed on beams 24. On upper surface 22 of deck 21 is sprayed foam layer 32. Gravel layer 35 is placed on upper surface 33 of foam layer 32.

Figure 2:
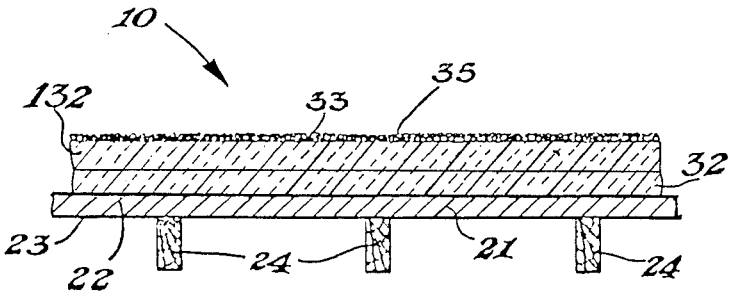
FIG. 2 is a cross-sectional view of a roof of the present invention in a further embodiment showing two layers of foam laid upon each other.

FIG. 2 is a further embodiment of the roof shown in FIG. 1 showing additionally however a second foamed layer 132 placed upon first foam layer 32.

The following example describes in detail a roof of the present invention and the method of preparing it. Many modifications, both of materials and methods, can be made without departing from the spirit and scope of this invention.

EXAMPLE I

To a wood roof deck, dried and cleaned of debris, is applied a 1½ inch layers of North Carolina Foam Industries, Inc., NCFI 584-2.5 (a two-component rigid urethane foam which, when mixed and sprayed in place according to manufacturer's directions, produces a 2.5 lb./cu.ft. core density). After the foam is applied, gravel meeting ASTMD 1863-83, Size Number 7, is applied at a rate of 400 lbs. to 100 square feet of foam surface.

In accordance with the above procedure, a second 1½ inch layer is applied after the first layer has set but before application of the gravel.

I claim:

1. A method of preparing a roof consisting of:

applying and affixing to an air and water vapor permeable roof deck, an unbroken layer of sprayed closed cell foam material covering the entire surface of said deck; and directly applying upon said foam layer a layer of gravel sufficient to prevent ultraviolet light deterioration of the foam.

2. The method according to claim 1 wherein the sprayed closed cell foam is applied to a depth of one inch or greater.

3. The method according to claim 1 wherein the sprayed closed cell foam is applied in multiple layers to a total depth of about 3–5 inches.

4. The method according to claim 1 wherein the gravel layer is applied at a rate of about 200–500 lbs. per 100 square foot of foam roof surface.

5. The method according to claim 1 wherein the gravel layer is applied at a rate of about 400 lbs. per 100 square foot of foam roof surface.

6. The method according to claim 1 wherein the sprayed closed cell foam is of the polyurethane type.

7. A roof structure consisting of:

an air and water vapor permeable roof deck supporting an unbroken layer of sprayed closed cell foam material covering the entire surface of said deck, the upper surface of said foam layer being layered with gravel in an amount sufficient to prevent ultraviolet light deterioration of the foam.

8. The roof structure according to claim 7 wherein the sprayed closed cell foam material is provided as layers of a depth of one inch or greater per layer.

9. The roof structure according to claim 7 wherein the sprayed closed cell foam material is layered to a depth of about 3–5 inches.

10. The roof structure according to claim 7 wherein the gravel layer is about 200–500 lbs. per square foot of foam roof surface.

11. The roof structure according to claim 10 wherein the gravel layer is about 400 lbs. per square foot of foam roof surface.

12. The roof structure according to claim 7 wherein the sprayed closed cell foam is of the polyurethane type.

* * * * *